US007415934B2

(12) United States Patent
Takken

(10) Patent No.: US 7,415,934 B2
(45) Date of Patent: Aug. 26, 2008

(54) THREE-DIMENSIONAL CAMOUFLAGE MATERIAL HAVING CUPPED HEAT DEFORMATIONS AT DISCREET LOCATIONS AND METHOD FOR MAKING SAME

(76) Inventor: Paul E. Takken, 29 Ida Reo, Sparta, MI (US) 49345

( * ) Notice: Subject to any disclaimer, the term of this patent is extended or adjusted under 35 U.S.C. 154(b) by 219 days.

(21) Appl. No.: 11/526,357

(22) Filed: Sep. 25, 2006

(65) Prior Publication Data

US 2007/0113766 A1 May 24, 2007

Related U.S. Application Data

(60) Provisional application No. 60/720,059, filed on Sep. 23, 2005.

(51) Int. Cl.
*D05B 35/06* (2006.01)
*B32B 7/08* (2006.01)

(52) U.S. Cl. ..... 112/475.08; 112/117; 156/93; 428/919; 428/17

(58) Field of Classification Search ..... 112/117, 112/475.08, 152, 470.33, 307; 156/61, 85, 156/93, 268, 84; 428/102, 919, 17, 15; 2/244, 2/900, 94

See application file for complete search history.

(56) References Cited

U.S. PATENT DOCUMENTS

| | | | | |
|---|---|---|---|---|
| 4,931,320 | A * | 6/1990 | Leonard | 428/17 |
| 5,261,978 | A * | 11/1993 | Reynolds | 156/84 |
| 5,486,385 | A * | 1/1996 | Bylund et al. | 428/17 |
| 6,754,910 | B2 * | 6/2004 | Shultz et al. | 2/244 |
| 6,991,690 | B2 * | 1/2006 | Strength et al. | 156/61 |

* cited by examiner

*Primary Examiner*—Ismael Izaguirre
(74) *Attorney, Agent, or Firm*—Jonathon A. Bay

(57) ABSTRACT

A process for producing a camouflage material having a three-dimensional surface contour comprises providing a plurality of parallel strips of thermoplastic camouflage material having irregular side edges and positioning the strips, preferably with overlapping edges, on an underlying substrate in a multiple head bonding machine, such as a quilting machine, that simultaneously bonds a number of strips of material to the substrate in parallel fashion. Prior to bonding the strips to the substrate, the strips are spaced apart from the substrate and freely suspended. While freely suspended, a series of hot gas pulses (typically hot air) are delivered at spaced, discreet locations along the longitudinal outer surface of the strips of camouflage fabric. The temperature and duration of the air pulses are such that the hot pulses form shallow, cup-shaped depressions in the camouflage fabric, causing the camouflage fabric to spring away from the plane of the substrate at intermittent intervals along its length.

6 Claims, 3 Drawing Sheets

THREE-DIMENSIONAL CAMOUFLAGE MATERIAL HAVING CUPPED HEAT DEFORMATIONS AT DISCREET LOCATIONS AND METHOD FOR MAKING SAME

CROSS-REFERENCE TO RELATED APPLICATIONS

This application is based on and claims the benefit of the filing date of Applicant's U.S. Provisional Application No. 60/720,059, filed Sep. 23, 2005, the disclosure of which is incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a three-dimensional fabric used in the manufacture of camouflage garments. In particular, the invention relates to a method of manufacturing a composite camouflage construction having a pliable substrate and an outer layer comprising parallel strips of a camouflage fabric having irregular side edges, wherein the strips are first thermally deformed by intermittent heat pulses and then are bonded to the substrate along plural spaced lines of attachment. The heat pulses cause the attached leafy shaped material to spring away from the plane of the substrate and give a three-dimensional, high definition, optical impression of the depth of natural foliage used to create camouflaged material garments made from the three-dimensional fabric.

2. Description of Related Art

Camouflage garments worn by hunters, warriors and armed forces personnel for purposes of concealment most likely predate written history. In the more recent past, a variety of garments have been manufactured in an attempt to impart a three-dimensional forest appearance to the surfaces of a garment. One method of manufacture utilizes multiple layers of strips of material to produce a garment known in the art as a "Ghillie Suit." A problem with the Ghillie Suit however is that they are heavy, cumbersome and expensive.

Another method of manufacture utilizes material which is photo-imprinted with naturalistic forest scenes. A problem with this prior art is that photo-imprinted garments do not provide any three-dimensional depth and it does not conceal the silhouette of the garment or its wearer.

Another type of three-dimensional garment is produced by stitching a layer of camouflage material onto an underlying fabric in a "quilting" fashion. The camouflage layer is then cut into a leafy shape and affixed to an underlying fabric or substrate. Although this method of fabric manufacturing provides something of a three-dimensional effect, a problem with the prior art is that the resulting outer "leafy" layer tends to lay flat against the substrate unless and until the fabric is bent around body parts when the garment is worn.

Efforts have been made to attempt to improve these types of garments by minimally heating and shrinking the outer material. Typically, the heating steps are performed subsequent to the attachment of the outer material to the substrate and employ continuous application of hot air or infrared radiation. A problem with the prior art is that heating and shrinking the outer material cannot be used where the substrate is a waterproof material or scent absorbing material whose typical melting point is significantly less than the temperature required to cut the outer layer using a hot air process. Also, heat deformation is impaired when the outer layer is already secured in position on a substrate.

In applicant's copending patent application, filed on even date herewith (which is incorporated herein by reference), an improved process for producing three-dimensional camouflage material is described, wherein wrinkles are mechanically formed in the outer layer of camouflage fabric by effectively feeding the camouflage fabric into a sewing machine at a rate or in quantities in excess of the speed of the substrate material, thereby providing wrinkles in the outer layer of material. The present invention provides an alternative method for accomplishing a permanent three-dimensional contour to the strips of camouflage fabric without employing modified sewing techniques and without requiring more fabric in the outer layer than the inner layer because of the wrinkles in the outer layer.

An object of the present invention is to provide the foregoing advantages in a continuous fabric manufacturing operation whereby three-dimensional fabric can be economically provided to garment manufacturers for fabrication into garments.

SUMMARY OF THE INVENTION

In accordance with the present invention, a process for producing a camouflage material having a three-dimensional surface contour comprises providing a plurality of parallel strips of camouflage material having irregular side edges and positioning the strips on an underlying substrate in a multiple head bonding machine, such as a quilting machine, that simultaneously bonds a number of strips of material to the substrate in parallel fashion. Prior to bonding the strips to the substrate, the strips are spaced apart from the substrate and freely suspended. While freely suspended, a series of hot gas pulses (typically hot air) are delivered at spaced, discreet locations along the longitudinal outer surface of the strips of camouflage fabric. The camouflage fabric is formed of a thermoplastic material. The characteristics of the camouflage fabric and the temperature and duration of the pulse air are such that the strips of camouflage fabric are heat deformed to form shallow cup-shaped depressions in the camouflage fabric, resulting in the camouflage fabric springing away from the plane of the substrate at intermittent intervals along its length.

The use of heat deformation at intermittent intervals reduces dependence on sewing techniques to achieve a three-dimensional contour, produces a permanent set in the camouflage fabric that is not lost when the fabric is wound tightly on a roll, and avoids the necessity of using additional camouflage fabric as occurs in gathering or folding techniques employed for the purpose of producing a three-dimensional effect.

These and other features of the present invention will appear, and for purposes of illustration, but not of limitation, preferred embodiments of the present invention are described below and shown in the appended drawings.

DETAILED DESCRIPTION OF THE INVENTION

Figure 1:
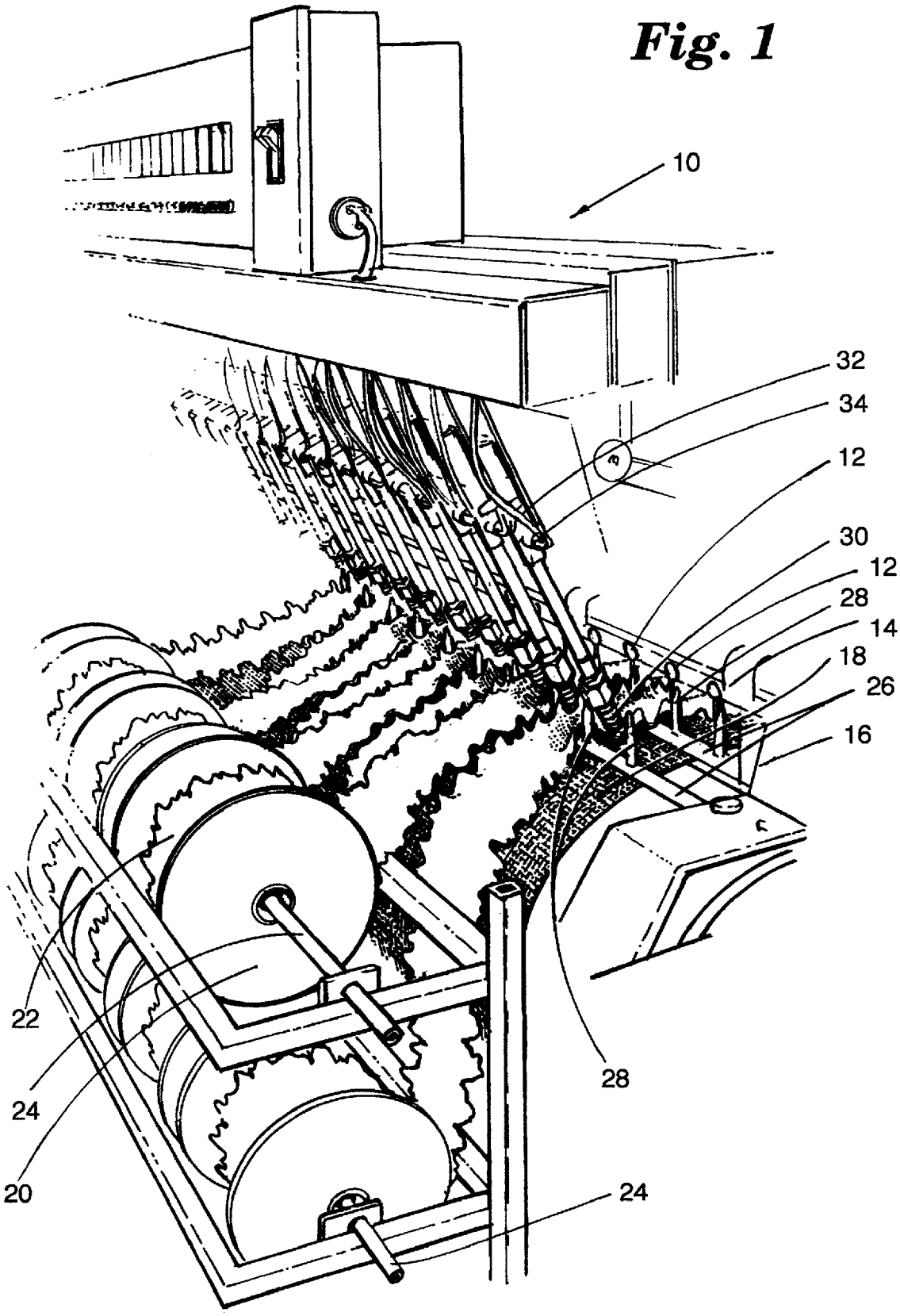
FIG. 1 is a perspective view of a multi-head bonding machine employed in the process of manufacturing camouflage material in accordance with the present invention.

Referring now to the drawings, a multi-head sewing machine, known as a quilting machine 10 is shown in FIG. 1. A quilting machine has a number of sewing heads 12 mounted on a vertically moveable bridge 14 across the width of a frame 16. The quilting machine in the present invention can typically have about seventeen sewing heads mounted side by side for simultaneous operation.

A roll of substrate material 18 is mounted across the front lower portion of the quilting machine such that a leading edge of the substrate material will pass longitudinally under the sewing heads.

A plurality of narrower spools 20 of camouflage fabric 22 are mounted on transverse shafts 24 positioned above the substrate material, so that the individual strips of camouflage fabric mounted on the spools can be fed into the quilting machine at spaced lateral locations along the width of the quilting machine. Desirably, each spool of camouflage fabric is positioned to as to be centered with respect to one of the sewing heads of the quilting machine.

In a normal quilting operation, the upper and lower sheets quilted together are single overlying sheets, not a series of strips arranged laterally across a lower substrate. The use of individual spools of strips 22 involves some arrangements to make sure that the strips remain aligned with the sewing heads.

In the present invention, a pair of longitudinally spaced spacer bars 26 are positioned between the substrate and the camouflage strips. The spacer bars have a series of laterally spaced vertical projections 28 extending upwardly therefrom that define the appropriate paths for camouflage fabric. These vertical projections make sure that the camouflage fabric passing through the projections remains in alignment with the hot air nozzles and the appropriate sewing head that stitches the camouflage fabric to the substrate.

The spacer bars provide another important function. They space the camouflage strips above the substrate and maintain the strips in an unsupported condition while the strips are subjected to heat deformation.

Heat deformation is accomplished by a series of laterally spaced hot air (or other hot gas) nozzles 30 positioned immediately adjacent the upper surface of the camouflage fabric at a position between spacer bars 26. Hot air for the nozzles can be provided by a conventional heater mechanism that provides a supply of compressed hot air to the nozzles. The nozzles can include manual shutoff valves 32 in the event that a particular nozzle is not to be used in a particular operation. The nozzles also include electrically operated actuator valves 34 that can be operated for timed intervals to provide discreet pulses of hot air to the outer surface of the unsupported camouflage fabric. The particular heat and time of pulse is controlled by a programmable computer controller.

Figure 2:
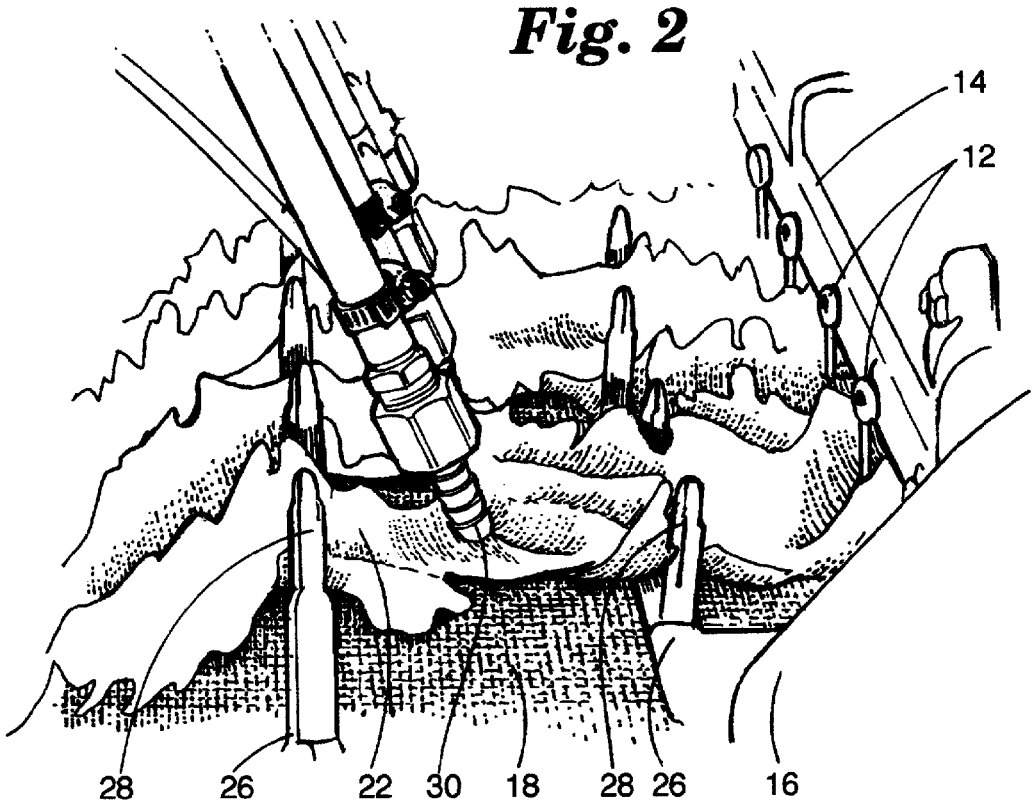
FIG. 2 is a perspective view showing the mechanism for applying intermittent hot air pulses to the exterior side of an unsupported strip of camouflage fabric.
Figure 3:
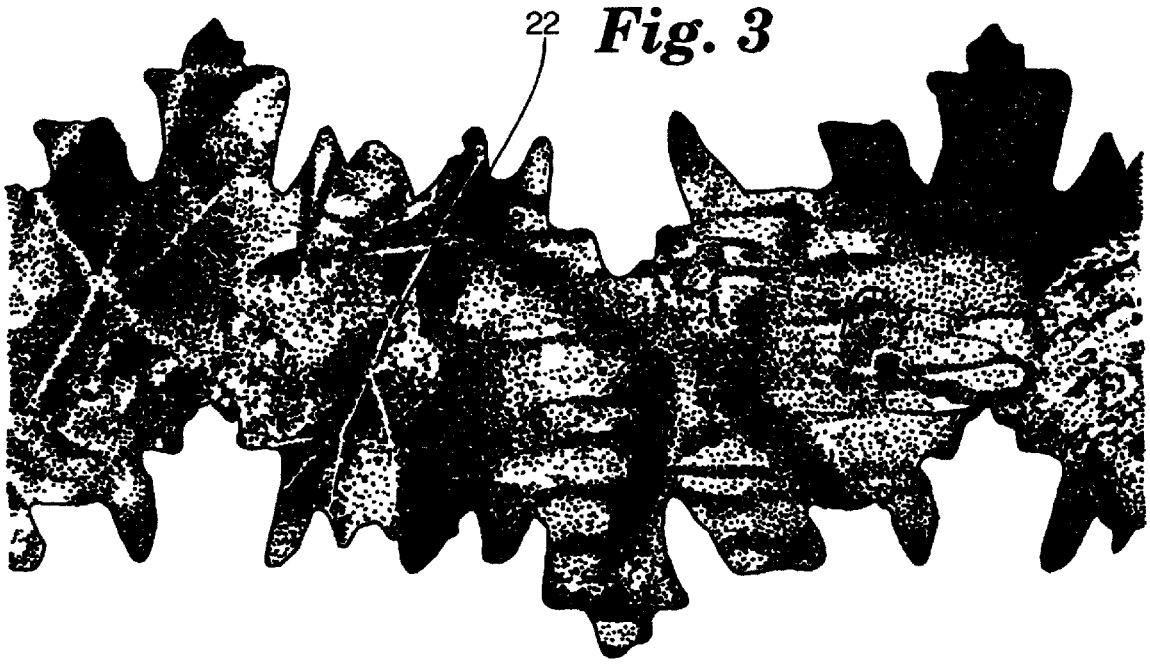
FIG. 3 is a plan view of an exemplary strip of camouflage fabric having cup-shaped heat deformations at discreet locations.
Figure 4:
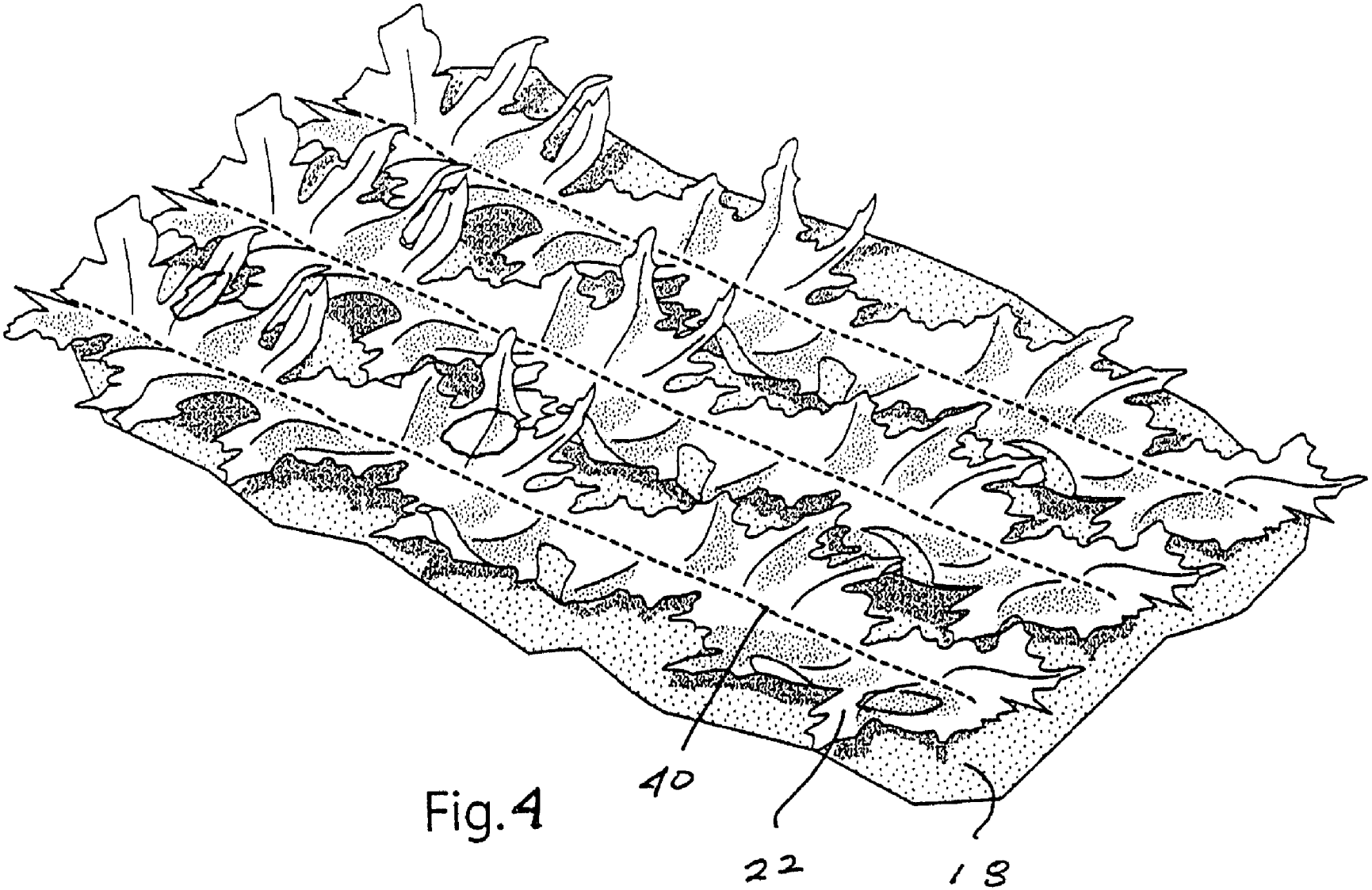
FIG. 4 is a perspective view of an exemplary sheet of camouflage material in accordance with the present invention.

As shown in FIG. 2, the nozzles are positioned above the strips and are positioned close enough to the strips that the heat from the hot air pulses is directed substantially solely at the camouflage strips and is not sufficient to pose any threat of heat deformation to a typical heat sensitive underlying substrate material.

While the rate of feed of a camouflage material and the temperature of the hot air jet and the duration of the jet all are factors that are taken into account with any particular camouflage fabric, in a typical situation, using a polyester pongee fabric, the hot air jet is of sufficient temperature to exceed the heat set temperature of the fabric and is delivered for a pulse duration of sufficient length to permanently achieve the desired cupping effect without searing or burning the pongee fabric. In practical applications, the adjustment of these factors is a matter of trial and error, with the fabric being inspected after each pulse and the controls being adjusted accordingly in order to provide an outer cupped contour without substantial shrinking or melting of the fabric.

Typically, a hot air pulse is delivered to a camouflage fabric at approximately every two inches along the fabric. The spacing can be varied and intermittent in order to provide a more random effect. This can all be accomplished with a conventional computer controller.

Immediately after the cupped contour has been provided to the camouflage fabric, the camouflage fabric is fed into the sewing heads of the quilting machine along with the substrate material and secured to the substrate material by conventional stitching techniques that produce a conventional lock stitch.

While a multi-head sewing machine is an acceptable way to bond the strips of camouflage fabric to the substrate, other techniques are known and can be employed, such as heat bonding and the like.

By using separate rolls of strips of camouflage fabric, the rolls can be positioned so that the edges of adjacent strips substantially overlap when they are sewn to the substrate material along parallel lines of attachment. The overlapping configurations can be achieved by mounting the adjacent spools of camouflage fabric on separate transverse shafts or axles 24, so that the fabric will overlap when fed to the appropriate sewing head. With the cupped outer contour of the camouflage fabric and the overlaying layers of camouflage fabric, a cupped layer will also cause the overlaying layer to spring away from the plane of the substrate, thus providing an even more pronounced three-dimensional effect.

In an exemplary embodiment of the present invention, strips 22 about 5 ¾ inches wide at their widest spacing are attached by lines of attachment that are approximately three inches apart. This causes the outermost edges of the strips to come close to but not overlap the lines of attachment of the adjacent strip. The strips can be made narrower, if desired, and the lines of attachment can be altered. If the lines of attachment are to be so close that the outer ends of the strips overlap an adjacent line of attachment, a danger of having the outer ends sewn down in the adjacent line of attachment exists. This problem associated with overlapping strips can be avoided by performing the stitching function upside down, so the edges of the camouflage strips hang down from the substrate and do not interfere with the stitching operation.

The foregoing construction provides a number of advantages over prior products. Conventional sewing techniques can be employed, and it is not necessary to modify techniques so as to provide a more rapid feed of one material than another in order to produce a wrinkled effect. In addition, no additional expense is encountered because of a requirement for extra material to accommodate lateral wrinkling or folding. Also, heat deformation provides a permanent set that is not lost when the material is rolled or fastened tightly on a roller.

Finally, this can all be accomplished in an automatic, continuous process in a reliable, cost effective manner.

It should be understood that the foregoing is merely exemplary of the preferred practice of the present invention and that various changes in the details and arrangements of the embodiments disclosed herein may be made without departing from the spirit and scope of the present invention.

I claim:

1. A process for producing a camouflage material having a three-dimensional surface contour comprising:

providing a multi-head bonding machine that bonds overlying layers of material together along spaced longitudinal lines of attachment;

providing a roll of an elongated web of a substrate material of a predetermined width;

positioning the roll in position to feed the substrate material into the bonding machine;

providing an elongated web of an outer layer of camouflage material, the outer layer comprising a plurality of elongated strips of camouflage fabric having a desired pattern applied thereto, the strips of camouflage fabric having irregular side edges, each strip being a width substantially narrower than the width of the substrate;

arranging the strips in rolls and positioning the rolls adjacent the substrate, such that the strips are fed into the bonding machine with the substrate, the rolls of strips being positioned such that different rolls of strips are aligned with different bonding heads;

causing the rolls of camouflage fabric and substrate material to be conveyed through the bonding machine for bonding together at spaced lines of attachment by separate bonding heads;

separating the camouflage fabric from the substrate, such that the camouflage fabric is in an un-supported position, prior to entry of the materials in the bonding heads;

applying a pulsed jet of hot fluid to the exterior surface of the camouflage fabric while the camouflage fabric is in its unsupported position and moving toward the bonding heads, the pulsed jet being applied at discreet time intervals so as to produce discreet, longitudinally spaced cup-shaped heat deformations along the camouflage fabric prior to the camouflage fabric being bonded to the substrate; and bonding the camouflage fabric to the substrate after the cup-shaped heat deformations are formed therein, the heat deformations causing the cup-shaped portions of the strips of camouflage material to spring away from the plane of the substrate material, giving the camouflage material a three-dimensional surface contour.

2. A process as in claim 1 wherein the strips of camouflage fabric are disposed and attached to the substrate material such that side edges of at least some strips overlap the side edges of adjacent strips, the overlapping edging urge the edges out of planar alignment and into a three-dimensional contour.

3. A process as in claim 2 wherein the side edges of the strips are formed in irregular patterns and are positioned relative to adjacent strips such that the outer edges of at least some adjacent strips do not mate.

4. A process as in claim 1 wherein the bonding machine is a quilting machine that bonds the camouflage material to the substrate by a plurality of laterally spaced sewing heads.

5. A camouflage material produced in accordance with the process of claim 1.

6. A process for producing a camouflage material having a three-dimensional surface contour comprising:

providing a multi-head bonding machine that bonds overlying layers of material together along spaced longitudinal lines of attachment;

providing a roll of an elongated web of a substrate material of a predetermined width;

positioning the roll in position to feed the substrate material into the bonding machine;

providing an elongated web of an outer layer of camouflage material, the outer layer comprising a plurality of elongated strips of camouflage fabric having a desired pattern applied thereto, the strips of camouflage fabric having irregular side edges, each strip being a width substantially narrower than the width of the substrate;

arranging the strips in rolls and positioning the rolls adjacent the substrate, such that the strips are fed into the bonding machine with the substrate, the rolls of strips being positioned such that different rolls of strips are aligned with different bonding heads;

causing the rolls of camouflage fabric and substrate material to be conveyed through the bonding machine for bonding together at spaced lines of attachment by separate bonding heads;

applying a pulsed jet of hot fluid to the exterior surface of the camouflage fabric while the camouflage fabric is moving toward the bonding heads, the pulsed jet being applied at discreet time intervals so as to produce discreet, longitudinally spaced cup-shaped heat deformations along the camouflage fabric prior to the camouflage fabric being bonded to the substrate; and bonding the camouflage fabric to the substrate after the cup-shaped heat deformations are formed therein, the heat deformations causing the cup-shaped portions of the strips of camouflage material to spring away from the plane of the substrate material, giving the camouflage material a three-dimensional surface contour.

* * * * *